US007878040B2

(12) United States Patent
Taya et al.

(10) Patent No.: US 7,878,040 B2
(45) Date of Patent: Feb. 1, 2011

(54) METHOD OF DRAWN AND IRONED PROCESSING OF RESIN COATED METAL SHEET AND RESIN COATED DRAWN AND IRONED CAN PRODUCED THEREBY

(75) Inventors: Shinichi Taya, Yamaguchi (JP); Masahiro Kai, Yamaguchi (JP); Junichi Tanabe, Yamaguchi (JP); Etsuro Tutsumi, Yamaguchi (JP); Norihito Saiki, Kanagawa (JP)

(73) Assignees: Toyo Kohan Co., Ltd., Tokyo (JP); Toyo Seikan Co., Ltd., Tokyo (JP)

( * ) Notice: Subject to any disclaimer, the term of this patent is extended or adjusted under 35 U.S.C. 154(b) by 618 days.

(21) Appl. No.: 11/661,687

(22) PCT Filed: Jun. 27, 2005

(86) PCT No.: PCT/JP2005/011704

§ 371 (c)(1),
(2), (4) Date: Mar. 24, 2008

(87) PCT Pub. No.: WO2006/025147

PCT Pub. Date: Mar. 9, 2006

(65) Prior Publication Data

US 2009/0013751 A1 Jan. 15, 2009

(30) Foreign Application Priority Data

Sep. 2, 2004 (JP) ..... 2004-256096

(51) Int. Cl.
*B21D 22/00* (2006.01)

(52) U.S. Cl. ..... 72/349; 72/379.4

(58) Field of Classification Search ..... 72/344, 72/348, 349, 379.4, 715, 347
See application file for complete search history.

(56) References Cited

U.S. PATENT DOCUMENTS 3,945,231 A * 3/1976 Imazu et al. ..... 72/45

(Continued)

FOREIGN PATENT DOCUMENTS

JP 52-36565 3/1977

(Continued)

*Primary Examiner*—Edward Tolan
(74) *Attorney, Agent, or Firm*—Browdy and Neimark, PLLC

(57) ABSTRACT

A method of drawn and ironed processing of a resin coated metal sheet, in which in the drawn and ironed processing of resin coated metal sheet, there can be obtained a can body of satisfactorily small wall thickness and at an opening edge part of the can body, the coating resin is free from any defect; and a resin coating drawn and ironed processed can produced thereby.

There is provided a method of drawn and ironed processing of a resin coated metal sheet, comprising performing drawn and ironed processing of a resin coated metal sheet composed of a metal sheet having at least one major surface thereof coated with an organic resin with the use of a punch and a die into a can body, characterized in that ironing is conducted with the use of a punch having a small-diameter portion at its rear end so that the ratio of ironing at an opening edge part of the can body after shaping falls within the range of 0 to 15%. Further, there is provided a drawn and ironed processed can of resin coated metal sheet produced through the processing method.

11 Claims, 2 Drawing Sheets

U.S. PATENT DOCUMENTS 3,951,296 A * 4/1976 Swanson et al. ..... 220/669
3,972,217 A * 8/1976 Misonoo ..... 72/344
4,373,368 A * 2/1983 Heijting ..... 72/344
4,442,692 A * 4/1984 Lyu ..... 72/349
4,485,663 A * 12/1984 Gold et al. ..... 72/347
5,544,517 A * 8/1996 Shimizu ..... 72/349
7,337,646 B2 * 3/2008 Aoyagi et al. ..... 72/349

FOREIGN PATENT DOCUMENTS

JP 60-168643 A 9/1985
JP 05-154570 6/1993
JP 2003-19518 A 1/2003

* cited by examiner

METHOD OF DRAWN AND IRONED PROCESSING OF RESIN COATED METAL SHEET AND RESIN COATED DRAWN AND IRONED CAN PRODUCED THEREBY

TECHNICAL FIELD

The present invention relates to a method of drawing and ironing a resin-coated metal sheet, and more particularly to a processing method which does not form any resin hair at the open end of any can body during its ironing, but can make a can having a satisfactorily thin sidewall thickness, and a drawn and ironed resin-coated can made by employing the same.

BACKGROUND ART

A drawn and ironed can has hitherto been formed as shown in FIG. 1. After a blank is punched from a metal sheet and drawn into a cup, an ironing apparatus having a punch 2 and a plurality of ironing dies 3 is used to finish the drawn cup into a can of predetermined sidewall thickness and height by setting the cup on the punch 2 and inserting it with the punch through the ironing dies. Large quantities of lubricant oil and cooling water are used to lubricate and cool the material during its drawing and ironing.

Attempts have recently been made to produce a can of still smaller sidewall thickness by ironing a can body formed from a resin-coated metal sheet by a conventional method consisting mainly of drawing, in order to realize environment preservation and a further reduction in mass of the can body. However, when a drawn and ironed can is formed from a resin-coated metal sheet by employing a traditional apparatus for forming a drawn and ironed can as shown in FIG. 1, an organic resin 1f coating a metal sheet 1*m* is soft as compared with the metal sheet so that the organic resin near the open end of a can body is sticked out from the open end of the can body and cut, as shown in FIG. 1, by a very high pressure occurring between the tool and the material at the time of ironing to form thread-like cutting as shown at 1*h* (hereinafter called resin hair). The resin hair is more likely to occur when ironing after drawing achieves a total ironing ratio of 15% or more. The resin hair occurring in a process for making drawn and ironed cans from resin-coated metal sheets continuously adheres to the punch or ironing die and thereby damages the coating resin on the surface of another drawn can that is going to be ironed. Thus, it is very difficult to form a drawn and ironed can from a resin-coated metal sheet by employing a traditional apparatus for forming a drawn and ironed can.

As a method of preventing resin hair from occurring when a resin-coated metal sheet is formed into a can body, there is disclosed a method in which a circular organic resin-coated metal sheet is held by an annular holding member and a drawing die, a drawing punch installed coaxially with the holding member and the drawing die and movably into and out of the holding member and the drawing die are moved relative to each other so as to engage with each other, and the circular metal sheet is formed into a drawn cup, in which at least one of the annular holding member and the drawing die is moved away from its pressure on the remaining-flange portion immediately before the ending of the drawing process to release the rear end of the flange portion to complete its drawing and thereby prevent any resin hair from occurring (see, for example, Patent Literature 1).

This method is aimed at preventing any resin hair from occurring when a drawn cup is formed, and it is possible to employ for drawing the annular holding member and drawing die which are movable to any coaxial position, but as the ironing step of the drawing and ironing process for attaining the object of the present invention is a method employing a punch passed through the inside diameter of an ironing die, and the inside diameter of the ironing die and the outside diameter of the punch are invariable during the process, it is impossible to release a high pressure produced between the tool and the material during the ironing of a resin-coated metal as stated before.

The following is information on prior art literature to which the present application pertains:

Patent Literature 1: JP-A-05-154570

DISCLOSURE OF THE INVENTION

Problems to be Solved by the Invention

It is an object of the-present invention to provide a method of ironing a resin-coated metal sheet in which a drawn cup formed from a resin-coated metal sheet obtained by coating at least one surface of a metal sheet with a resin is ironed to make a can body which is of satisfactorily small sidewall thickness and free from any resin hair at its open end, and a drawn and ironed resin-coated can made by employing the same. It is another object of the present invention to provide a method of ironing an organic resin-coated metal sheet in which when ironing is performed by at least two dies having the minimum possible land distance therebetween, such as two dies installed contiguously to each other, the back tension produced by the former ironing die is effectively utilized for ironing by the latter die to realize an improved ratio of reduction in the sidewall thickness of the can body by each ironing die (limit ironing ratio), as well as a drastic reduction in the diametrical deformation of the latter ironing die to make a can body which is uniform and even along its circumference.

Means for Solving the Problems

The method of drawing and ironing a resin-coated metal sheet according to the present invention is characterized in that when a resin-coated metal sheet obtained by coating at least one surface of a metal sheet with an organic resin is drawn and ironed into a can body by employing a punch and a die, a punch having a reduced diameter portion toward its rear end is used to perform ironing to form a can body having an ironing ratio of 0 to 15% at its open end.

Referring to the die used for ironing, it is desirable to use a plurality of dies, dispose at least two dies with a land distance of 3 to 40 mm and use the former of the two dies to perform 20% or more of the total ironing work by the two dies. It is also desirable to perform ironing by the two dies so installed that the former and latter dies may be contiguous to each other.

The drawn and ironed can of a resin-coated metal sheet according to the present invention is characterized by forming by employing either of the ironing methods described above.

BEST MODE OF CARRYING OUT THE INVENTION

Figure 1:
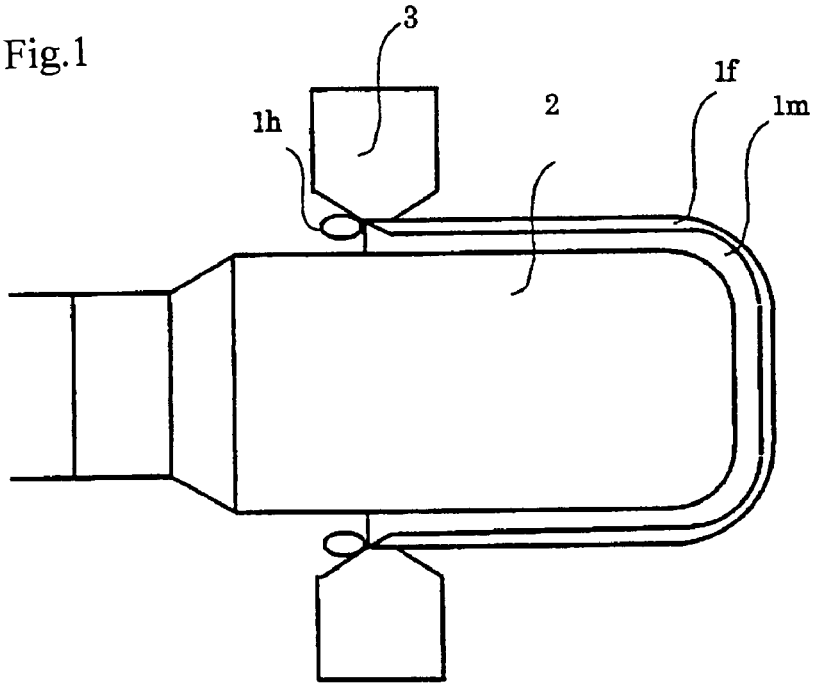
FIG. 1 is a schematic sectional view showing a part of a traditional process for ironing a drawn cup formed from a resin-coated metal sheet.
Figure 2:
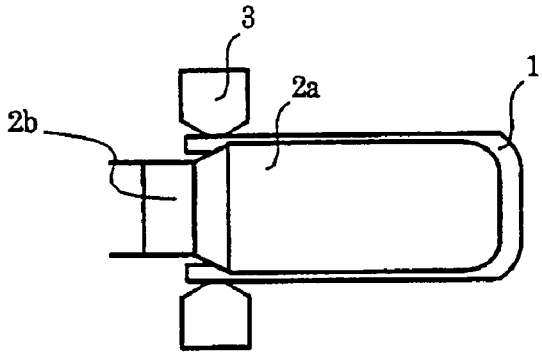
FIG. 2 is a schematic sectional view showing an example of the process for ironing a drawn cup formed from a resin-coated metal sheet according to the present invention.

According to the present invention, a drawn and ironed can is formed as will now be described. After a blank is punched from a resin-coated metal sheet and drawn into a cup by a traditional method, an ironing apparatus including a punch 2*a* having a reduced diameter or tapered portion 2*b* to give an ironing ratio of 0 to 15% to the open end of a can body and an ironing die 3 positioned ahead of it as shown in FIG. 2 is used to perform the ironing of the drawn cup 1 by setting the drawn cup 1 on the punch and inserting it with the punch 2*a* through the ironing die 3, whereby the drawn cup 1 gives a can body of reduced sidewall thickness and increased height. A preferred punch has a reduced diameter or tapered portion giving an ironing ratio of 0 to 10% to the open end of the can body. The ironing ratio was calculated by comparing with the wall thickness prior to ironing its thickness after ironing as obtained by measuring the wall thickness of the ironed can 1 mm below its lowest height. When the open end of the can body is moved past the ironing die 3, no ironing is given to the coating resin on the can body at its open end to any extent causing its damage, since the reduced diameter portion of the punch 2*a* and the inner surface of the ironing die 3 have therebetween a clearance wider than what causes damage to the coating resin. Accordingly, the drawn cup 1 ironed on the punch 2*a* forms a can body having a thick wall portion toward its open end and not having any resin hair formed at its open end. The reduced diameter portion 2*b* of the punch 2*a* may be defined as a portion having a sharply reduced diameter, but is preferably formed as a tapered portion having a gradually reduced diameter resulting midway in a diameter at which no further ironing takes place, so that a gradual release of ironing pressure may be possible. It is desirable for the tapered portion to start at least 3 mm above the point defining the final can height (trimming point) A taper angle of 0.1 to 30 degrees is desirable. An angle of 0.5 to 5 degrees is more desirable. No taper angle of less than 0.1 degree is effective against the formation of resin hair, while any angle over 30 degrees is likely to present a problem in the strength of the punch or the vibration of the ironing punch.

Another method performs ironing by employing at least two dies so positioned as to have a land distance of 3 to 40 mm. The two dies may be two dies formed in a single body having two ironing portions, two dies connected to each other without anything disposed therebetween, or two dies installed with a spacer or the like disposed therebetween. The method in which ironing is performed by two dies so disposed as to have a land distance of 3 to 40 mm is desirable for the removal of the ironed can. An example in which the ironing dies are installed contiguously to each other is shown in FIGS. 3 to 6. An improved limit ironing ratio of about 64% can be achieved by a step of ironing, no resin hair is produced, but a can of greater height can be obtained.

Figure 3:
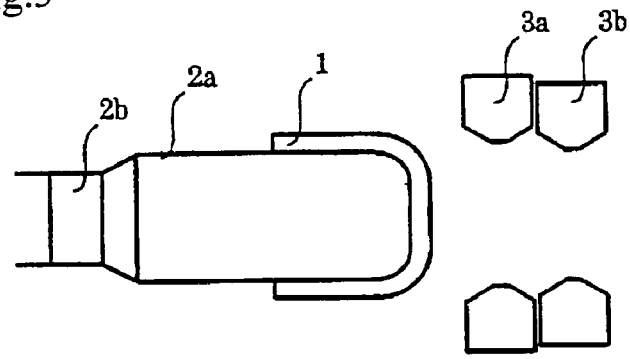
FIG. 3 is a schematic sectional view showing another example of the process for ironing a drawn cup formed from a resin-coated metal sheet according to the present invention.
Figure 4:
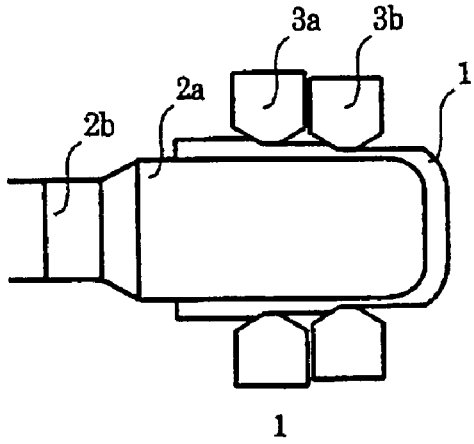
FIG. 4 is a schematic sectional view showing another example of the process for ironing a drawn cup formed from a resin-coated metal sheet according to the present invention.
Figure 5:
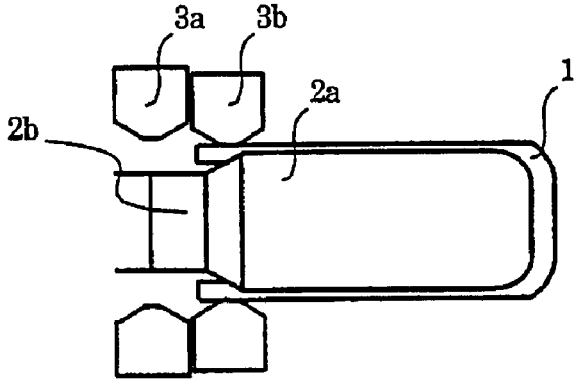
FIG. 5 is a schematic sectional view showing another example of the process for ironing a drawn cup formed from a resin-coated metal sheet according to the present invention.

An ironing apparatus including a punch 2*a* having a reduced diameter portion 2*b* so as not to iron the open end of a can body and ironing dies 3*a* and 3*b* positioned ahead of it as shown in FIG. 3 is used to perform the ironing of the drawn cup 1 by setting the drawn cup 1 on the punch 2*a* and inserting it with the punch 2*a* through the ironing dies 3*a* and 3*b* installed contiguously to each other as shown in FIG. 4, whereby the drawn cup 1 gives a can body of reduced sidewall thickness and increased height. When the open end of the can body is moved past the ironing dies 3*a* and 3*b*, no ironing is given to the coating resin on the can body at its open end to any extent causing its damage, since the reduced diameter portion of the punch 2*a* and the inner surfaces of the ironing dies 3*a* and 3*b* have therebetween a clearance wider than what causes damage to the coating resin. Accordingly, the drawn cup 1 ironed on the punch 2*a* forms a can body having a thick wall portion toward its open end and not having any resin hair formed at its open end. The reduced diameter portion 2*b* of the punch 2*a* may be defined as a portion having a sharply reduced diameter, but is preferably formed as a tapered portion having a gradually reduced diameter resulting midway in a diameter at which no further ironing takes place, so that a gradual release of ironing pressure may be possible. It is desirable for the tapered portion to start at least 3 mm above the point defining the final can height (trimming height). A taper angle of 0.1 to 30 degrees is desirable. An angle of 0.5 to 5 degrees is more desirable. No taper angle of less than 0.1 degree is effective against the formation of resin hair, while any angle over 30 degrees is likely to present a problem in the strength of the punch or the vibration of the ironing punch.

Figure 6:
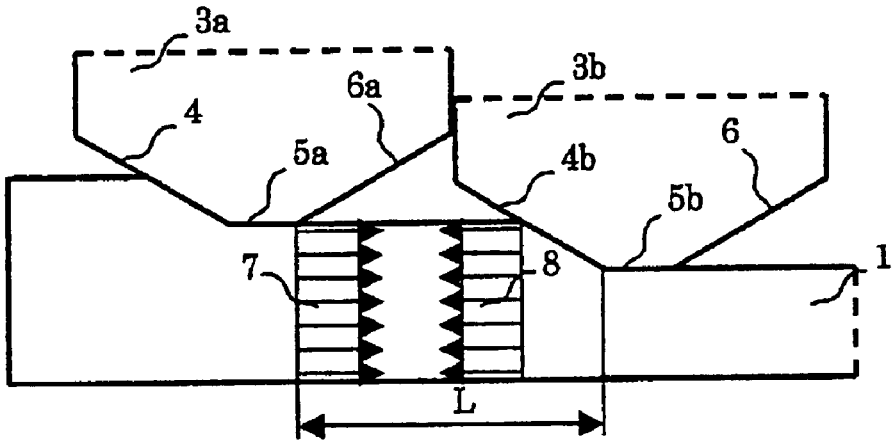
FIG. 6 is a schematic sectional view showing a part of the process for ironing a drawn cup formed from a resin-coated metal sheet according to the present invention. In the drawings, 1, 1*f*, 1*m*, 1*h*, 2, 2*a*, 2*b*, 3, 3*a*, 3*b*, 4*a*, 4*b*, 5*a*, 5*b*, 6*a*, 6*b*, 7 and 8 denote a drawn cup, an organic resin, a metal sheet, resin hair, an ironing punch, an ironing punch, a reduced diameter portion thereof, an ironing die, a former ironing die, a latter ironing die, the approach surface of the former ironing die, the approach surface of the latter ironing die, the land of the former ironing die, the land of the latter ironing die, the outlet surface of the former ironing die, the outlet surface of the latter ironing die, ironing stress and back tension, respectively.

Referring to FIG. 6 showing examples of the contiguously installed ironing dies for the purpose of the present invention, the ironing devices are composed of the former and latter ironing devices 3*a* and 3*b* and the former and latter ironing devices have die approach surfaces 4*a* and 4*b*, lands 5*a* and 5*b* and outlet surfaces 6*a* and 6*b*, respectively. Although each ironing device has the same function as the ironing portion of any known ironing die, the former and latter ironing devices are installed contiguously to each other according to the present invention, so that the axial forming stress 7 produced by the former ironing device may be effectively utilized as back tension 8 for ironing by the latter device to realize an improved limit ironing ratio by each ironing device, as well as a drastic reduction in the diametrical deformation of the latter ironing die to permit a uniform and even ironing job.

The contiguous installation of the former and latter ironing devices 3*a* and 3*b* means that they are both inserted about the ironing portion of the punch in a contiguous relation to each other, and the former and latter ironing devices 3*a* and 3*b* are desirably constructed separately from each other. It is alternatively possible to use a single unit having two ironing portions, or two dies installed with a spacer or the like disposed therebetween.

It is effective for the former and latter ironing devices to have a short land distance L therebetween so that the back tension by the former ironing device 3*a* may be effectively utilized to realize an improved limit ironing ratio and restrain the diametrical deformation of the latter ironing die, and their land distance L is preferably 40 mm or less. A land distance over 40 mm allows the effect of back tension, but is economically undesirable, since a lot of material has to be removed by trimming. From the standpoint of resource saving, a short land distance L is effective for a reduction in the volume of the thick wall portion of the can body at its open end and it is preferably in the range of 3 to 40 mm. It is more preferably in the range of 3 to 20 mm.

According to the present invention, the amount of ironing by the former ironing device is preferably 20% or more of the total amount of ironing by the former and latter ironing devices. The contiguous installation of the former and latter ironing devices and the performance of at least a specific ratio of ironing work by the former ironing device enable the latter ironing device to perform ironing in the state in which an adequate back tension prevails. This enables a reduction in the diametrical stress on the latter ironing die. This reduction makes it possible to suppress the diametrical deformation of the ironing die which is a defect resulting from a small die approach angle. When the amount of ironing by the former ironing device is less than 20% of the total amount of ironing by the former and latter ironing devices, the former ironing device produces so low a forming stress, and the back tension acting on the latter ironing device is, therefore, so low that no satisfactory result can be obtained in the improvement of ironing by the latter ironing device or in the suppression of any diametrical deformation of the latter ironing die.

The method of the present invention for ironing an organic resin-coated metal sheet is applicable to both a traditional ironing process employing a lubricant and cooling water and a dry ironing process employing a high-temperature volatile lubricant.

According to the present invention, no resin hair is formed at the open end of the can body by ironing during the drawing and ironing of an organic resin-coated metal sheet. The land distance of 3 to 40 mm between the dies makes it possible to achieve an improved limit ironing ratio of about 64% by the comvined ironing device as compared with about 55% by traditional ironing, and suppress the diametrical deformation of the latter ironing die to or below 50% of what has been caused by any traditional ironing method.

Although the examples of the present invention which will be described later will show the contiguously installed former and latter ironing devices as the devices for the first stage of ironing, it is also possible to perform drawing and ironing by employing a plurality of stages of ironing, such as a process preceding the contiguously installed former and latter ironing devices to perform ironing to any extent not causing damage to the coating organic resin, or a process following the contiguously installed former and latter ironing devices to perform 10% or less of ironing to improve the removability of the can body from the punch.

The ironing method of the present invention is particularly effective for ironing a metal sheet, such as electrolytically chromated steel sheet having a two-layer structure composed of a lower layer of metallic chromium and an upper layer of hydrated chromium oxide, tinplate or other plated or surface-treated steel sheet, stainless steel sheet, or aluminum or aluminum alloy sheet, coated on both sides with an organic resin selected from polyester, polyolefin, polyamide and other thermoplastic resins, a metal sheet coated with a thermoplastic or thermosetting resin paint, or an organic resin-coated metal sheet containing a pigment, a filler, etc. in the organic resin. An organic resin film desirably has a thickness of 5 to 100 μm. The resin film to which the present invention is applicable may be a film formed by a single layer, or two or more layers, and is preferably a film of a thermoplastic resin, especially a polyester resin.

The polyester resin preferably has an ester unit such as ethylene terephthalate, ethylene isophhalate, butylene terephthalate or butylenes isophthalate, and is preferably a polyester consisting mainly of at least one kind of ester unit selected therefrom. Each ester unit may be a copolymer, or the polyester may be a blend of homopolymers or copolymers of two or more kinds of ester units. It is also possible to use other ester units containing e.g. naphthalenedicarboxylic acid, adipic acid, sebacic acid or trimellitic acid as their acid component, or e.g. propylene glycol, diethylene glycol, neopentyl glycol, cyclohexanedimethanol or pentaerythritol as their alcohol component.

The polyester may be a laminate of two or more polyester layers composed of homopolyesters or copolyesters, or a blend of two or more thereof. For example, the polyester film may have a copolymerized polyester layer of high thermal adhesion as a lower layer, and a polyester or modified polyester layer of high strength, heat resistance and barrier property against corrosive substances as an upper layer.

According to the present invention, the polyester film may be a uniaxially or biaxially stretched or non-stretched film, but is desirably a non-stretched polyester resin film, and the resin is required to be sufficiently high in intrinsic viscosity and thereby in strength not to be broken when the polyester resin film is laminated on the surface-treated steel sheet, not to be scraped or damaged, or crack or be separated when the surface-treated steel sheet having the polyester resin film laminated thereon is subjected to severe forming work such as drawing or drawing and ironing.

Thus, the polyester resin preferably has an intrinsic viscosity in the range of 0.6 to 1.4 and more preferably in the range of 0.8 to 1.2. The polyester resins having an intrinsic viscosity below 0.6 are too low in strength to be applicable to any can made by drawing or drawing and ironing. The polyester resins having an intrinsic viscosity over 1.4 are so high in melt viscosity when melted by heating that any polyester resin film is very difficult to laminate on a surface-treated steel sheet.

The resin film preferably has a thickness of 5 to 100 μm and more preferably 10 to 40 μm when it is a single-layer film. Any film having a thickness below 5 μm is very difficult to laminate on a surface-treated steel sheet, is likely to give a defective resin layer upon drawing, or drawing and ironing and is unsatisfactory in impermeability to corrosive substances when a can is formed and filled with its contents. An increase in thickness gives satisfactory impermeability, but any thickness over 100 μm is economically a disadvantage. The proportions in thickness of the layers of a multi-layer film depend on formability, impermeability, their effects on the flavor of the contents of cans, etc., and the thicknesses of the layers are so controlled as to give a total thickness of 5 to 60 μm.

The resin film may be formed from a resin to which a coloring pigment, a stabilizer, an oxidation inhibitor, a lubricant, etc. have been added to the extent not impairing the necessary properties thereof. It is possible to use a metal sheet having a pigment-free polyester resin film laminated on its side supposed to define the inner surface of a can, while a polyester resin film containing a pigment, such as titanium oxide, is laminated on its side supposed to define the outer surface of the can.

An organic resin film may be laminated on a heated surface-treated steel sheet directly or with an adhesive. It is also possible to employ a method of extrusion lamination in which a molten resin is laminated directly on a surface-treated steel sheet. Any known lamination method may be employed.

EXAMPLES

The present invention will now be described in further detail by examples thereof.

Examples 1 to 10 and Comparative Examples 1 to 3

Employed as a sample sheet was an organic resin-coated steel sheet obtained by coating an electrolytically chromated steel sheet having a thickness of 0.200 mm with a transparent polyester film having a thickness of 28 μm on its side supposed to define the inner surface of a can and with a white polyester film containing a titanium oxide pigment and having a thickness of 16 μm on its side supposed to define the outer surface of the can. A circular blank having a diameter of 154 mm was punched out from the organic resin-coated steel sheet and was formed by a first stage of drawing into a drawn cup having a diameter of 91 mm and then by a second stage of drawing into a drawn cup having a diameter of 66 mm. The cup was ironed under conditions shown in Table 1 by employing an ironing apparatus including a punch having a reduced diameter or tapered portion 2*b* giving an ironing ratio of 15% or less to the open end of a can according to the present invention and a single stage of ironing device. Also employed for comparative purposes was an ironing punch employed by traditional ironing work and not having any reduced diameter portion at its upper end so as not to perform any ironing thereat.

The tests were conducted by employing four kinds of punches to lower the ironing degree of the can body at its open end. Every punch had its tapered portion started 130 mm from its distal end (corresponding to the bottom of the can) and its diameter reduced to 63 mm. Every punch marked as having a reduced diameter in Table 1 had a taper angle of 10 degrees at 130 mm.

TABLE 1

| No. | Shape of ironing punch (presence of reduced diameter portion) | Ironing die clearance (mm) |
|---|---|---|
| Comparative Example 1 | No reduced diameter portion | 0.095 |
| Comparative Example 2 | | 0.090 |
| Comparative Example 3 | Reduced diameter portion with a taper of 3.5 deg. | 0.120 |
| Example 1 | Reduced diameter portion | 0.105 |
| Example 2 | | 0.100 |
| Example 3 | | 0.095 |
| Example 4 | | 0.090 |
| Example 5 | Reduced diameter portion | 0.100 |
| Example 6 | with a taper of 0.5 deg. | 0.090 |
| Example 7 | Reduced diameter portion | 0.100 |
| Example 8 | with a taper of 3.5 deg. | 0.090 |
| Example 9 | Reduced diameter portion | 0.100 |
| Example 10 | with a taper of 5.0 deg. | 0.090 |

Examples 11 to 20 and Comparative Examples 4 to 9

Description will now be made of examples in which contiguously installed dies were employed.

Employed as a sample sheet was an organic resin-coated steel sheet obtained by coating an electrolytically chromated steel sheet having a thickness of 0.21 mm with a transparent polyester film having a thickness of 28 μm on its side supposed to define the inner surface of a can and with a white polyester film containing a titanium oxide pigment and having a thickness of 16 μm on its side supposed to define the outer surface of the can. A circular blank having a diameter of 148 mm was punched out from the organic resin-coated steel sheet and was formed by a first stage of drawing into a drawn cup having a diameter of 91 mm and then by a second stage of drawing into a drawn cup having a diameter of 66 mm. The cup was ironed under conditions shown in Table 2 by employing an ironing apparatus including a punch equal to that employed at paragraph and having a reduced diameter portion not performing ironing on the open end of a can according to the present invention and former and latter ironing dies. Also employed for comparative purposes was an ironing punch employed by traditional ironing work and not having any reduced diameter portion at its open end so as not to perform any ironing thereat.

TABLE 2

| No. | Shape of ironing punch (presence of reduced diameter portion) | First stage ironing die | | |
|---|---|---|---|---|
| | | Former portion clearance (mm) | Latter portion clearance (mm) | Distance between former and latter lands (mm) |
| Comparative Example 4 | No reduced diameter portion | — | 0.090 | — |
| Comparative Example 5 | Reduced diameter portion with a taper of 3.5 deg. | — | 0.090 | — |

TABLE 2-continued

| No. | Shape of ironing punch (presence of reduced diameter portion) | First stage ironing die: Former portion clearance (mm) | Latter portion clearance (mm) | Distance between former and latter lands (mm) |
|---|---|---|---|---|
| Comparative Example 6 | | — | 0.085 | — |
| Comparative Example 7 | No reduced diameter portion | 0.120 | 0.090 | 19.0 |
| Comparative Example 8 | No reduced diameter portion | 0.120 | 0.090 | 10.0 |
| Comparative Example 9 | Reduced diameter portion with a taper of 3.5 deg. | 0.185 | 0.090 | 19.0 |
| Example 11 | | 0.160 | 0.090 | 19.0 |
| Example 12 | | 0.140 | 0.090 | 19.0 |
| Example 13 | | 0.120 | 0.090 | 19.0 |
| Example 14 | | 0.095 | 0.090 | 19.0 |
| Example 15 | | 0.120 | 0.090 | 13.5 |
| Example 16 | | 0.120 | 0.090 | 10.0 |
| Example 17 | | 0.120 | 0.080 | 19.0 |
| Example 18 | Reduced diameter portion with a taper of 0.5 deg. | 0.120 | 0.090 | 19.0 |
| Example 19 | Reduced diameter portion with a taper of 5.0 deg. | 0.120 | 0.090 | 19.0 |
| Example 20 | Reduced diameter portion | 0.120 | 0.090 | 19.0 |

The thickness of the sidewall of each can body was measured before and after its ironing under several conditions to determine the ironing ratio of the can body in the middle portion of its sidewall (at a height of 60 mm above its bottom) and at its open end (at a point 1 mm below the lowest height of the can). The diametrical deformation of the ironing die, the ratio of ironing by each of the former and latter ironing dies and the total ratio of ironing were calculated for the ironing ratio at the height of 60 mm. Moreover, the formability of the can body and the state of resin hair were examined visually and through an optical microscope under various ironing conditions and ranked in accordance with the criteria as stated below. Each can body was also evaluated for its removability (hereinafter "strippability") from the punch by the visual examination of its deformation caused by its stripping from the punch.

[Formability of Can Body]

o: The can body could be formed without any problem.

Δ: The can body could be formed without having its sidewall broken, but its open end failed to reach a prescribed height.

x: The can body had its sidewall broken during its ironing.

[Can Height]

o: The can had a height reaching the upper reduced diameter or tapered portion of the punch.

x: The can did not have a height reaching the upper reduced diameter or tapered portion of the punch.

[Resin Hair]

o: No resin hair was found.

x: Resin hair was found to a practically undesirable extent.

o: The can body could be removed from the punch without being deformed.

Δ: The can body was deformed at its open end slightly and to a practically negligible extent.

x: The can body was deformed to a practically undesirable extent.

The results of these evaluations are shown in Tables 3 and 4.

TABLE 3

| No. | Can sidewall thickness (mm): At height 60 mm | At open end of can body | Ironing ratio (%): At height 60 mm | At open end of can body | Can height | Resin hair |
|---|---|---|---|---|---|---|
| Comparative Example 1 | 0.121 | 0.168 | 47.8 | 47.2 | o | x |
| Comparative Example 2 | 0.117 | 0.164 | 49.6 | 48.4 | o | x |
| Comparative Example 3 | 0.139 | 0.255 | 40.1 | 19.6 | x | x |
| Example 1 | 0.130 | 0.318 | 44.0 | 0.0 | o | o |
| Example 2 | 0.125 | 0.318 | 46.1 | 0.0 | o | o |
| Example 3 | 0.121 | 0.318 | 47.8 | 0.0 | o | o |
| Example 4 | 0.117 | 0.318 | 49.6 | 0.0 | o | o |
| Example 5 | 0.125 | 0.271 | 46.1 | 14.8 | o | o |
| Example 6 | 0.117 | 0.279 | 49.6 | 12.3 | o | o |

TABLE 3-continued

| No. | Can sidewall thickness (mm) At height 60 mm | Can sidewall thickness (mm) At open end of can body | Ironing ratio (%) At height 60 mm | Ironing ratio (%) At open end of can body | Can height | Resin hair |
|---|---|---|---|---|---|---|
| Example 7 | 0.125 | 0.288 | 46.1 | 9.4 | ○ | ○ |
| Example 8 | 0.117 | 0.295 | 49.6 | 7.2 | ○ | ○ |
| Example 9 | 0.125 | 0.302 | 46.1 | 5.0 | ○ | ○ |
| Example 10 | 0.117 | 0.312 | 49.6 | 1.9 | ○ | ○ |

TABLE 4

| No. | Can sidewall thickness (mm) At height 60 mm | Can sidewall thickness (mm) At open end of can body | Ironing ratio (%) At height 60 mm Former portion | Ironing ratio (%) At height 60 mm Latter portion | Ironing ratio (%) At height 60 mm Total | Ironing ratio (%) At open end of can body | Deformation of latter ironing die (mm) | Formability of can body | Resin hair | Strippability |
|---|---|---|---|---|---|---|---|---|---|---|
| Comparative Example 4 | 0.121 | 0.182 | — | 51.2 | 51.2 | 44.8 | 0.031 | ○ | x | x |
| Comparative Example 5 | 0.117 | 0.190 | — | 52.0 | 52.0 | 42.4 | 0.027 | ○ | x | x |
| Comparative Example 6 | 0.112 | — | — | 54.8 | 54.8 | — | 0.027 | x | | |
| Comparative Example 7 | 0.096 | 0.144 | 41.0 | 32.5 | 60.0 | 56.4 | 0.006 | ○ | x | ○ |
| Comparative Example 8 | 0.094 | 0.145 | 41.0 | 34.1 | 60.8 | 56.1 | 0.004 | ○ | x | ○ |
| Comparative Example 9 | 0.110 | 0.225 | 13.9 | 46.9 | 54.2 | 31.8 | 0.020 | Δ | x | Δ |
| Example 11 | 0.103 | 0.286 | 21.9 | 45.3 | 57.1 | 13.3 | 0.013 | ○ | ○ | ○ |
| Example 12 | 0.100 | 0.297 | 31.9 | 39.3 | 58.3 | 10.0 | 0.010 | ○ | ○ | ○ |
| Example 13 | 0.096 | 0.303 | 41.0 | 32.5 | 60.0 | 8.2 | 0.006 | ○ | ○ | ○ |
| Example 14 | 0.094 | 0.315 | 50.2 | 21.8 | 60.8 | 4.5 | 0.004 | ○ | ○ | ○ |
| Example 15 | 0.086 | 0.321 | 41.0 | 33.2 | 60.4 | 2.7 | 0.005 | ○ | ○ | ○ |
| Example 16 | 0.096 | 0.324 | 41.0 | 34.1 | 60.8 | 1.8 | 0.004 | ○ | ○ | ○ |
| Example 17 | 0.086 | 0.322 | 41.0 | 38.8 | 64.2 | 2.4 | 0.006 | ○ | ○ | ○ |
| Example 18 | 0.096 | 0.283 | 41.0 | 32.5 | 60.0 | 14.2 | 0.006 | ○ | ○ | ○ |
| Example 19 | 0.096 | 0.326 | 41.0 | 32.5 | 60.0 | 1.2 | 0.006 | ○ | ○ | ○ |
| Example 20 | 0.096 | 0.318 | 41.0 | 32.5 | 60.0 | 0.0 | 0.006 | ○ | ○ | ○ |

As is obvious from Table 3, the ironing of the open end of the can body at an ironing ratio of 0 to 15% makes it possible to form a drawn and ironed can from an organic resin-coated metal sheet without allowing its ironing to produce any resin hair at the open end of the can body.

As is obvious from Table 4, the drawing and ironing of an organic resin-coated metal sheet by contiguously installed dies make it possible to form a drawn and ironed can without allowing its ironing to produce any resin hair at the open end of the can body. Moreover, it is possible to achieve an improved limit ironing ratio of about 64% by the combination of plural ironing dies as compared with about 55% by traditional ironing, and suppress the diametrical deformation of the latter ironing die to or below 50% of what has been caused by any traditional ironing method. It is also possible to improve the strippability of the can body by dividing ironing work into the former and latter stages to reduce the residual stress of compression occurring around the circumference of the can body and by forming a thick wall portion toward the open end of the can body to improve its strength at its open end.

INDUSTRIAL APPLICABILITY

The method of the present invention does not allow any resin hair to be formed at the open end of an ironed can body made by the drawing and ironing of an organic resin-coated metal sheet. Moreover, the land distance of 3 to 40 mm between the dies makes it possible to achieve an improved limit ironing ratio of about 64% by the combination of plural ironing dies as compared with about 55% by traditional ironing, and suppress the diametrical deformation of the latter ironing die to or below 50% of what has been caused by any traditional ironing method.

The invention claimed is:

1. A method of drawing and ironing a resin-coated metal sheet, comprising:

preparing the resin-coated metal sheet manufactured by coating at least one surface of a metal sheet with an organic coating resin;

drawing and ironing the resin-coated metal sheet into a can body by employing a punch and a die, wherein the punch has a reduced diameter portion toward its rear end; and forming the can body having an ironing in the middle portion of its sidewall and substantially no ironing at its open end.

2. A method of drawing and ironing a resin-coated metal sheet as set forth in claim 1, further comprising:

using a plurality of dies for the ironing, disposing at least two dies with a land distance of 3 to 40 mm, and using the former of the two dies to perform 20% or more of the total ironing work by the two dies.

3. A method of ironing a resin-coated metal sheet as set forth in claim 1, comprising:

using two dies for the ironing, a former die and a latter die;

wherein the two dies are so arranged that the former and latter dies iron the resin-coated metal sheet contiguous to each other.

4. A drawn and ironed can of a resin-coated metal sheet which is made by employing an ironing method as set forth in claim 1.

5. A method of ironing a resin-coated metal sheet as set forth in claim 2, wherein the two dies are so arranged that the two dies are contiguous to each other.

6. A drawn and ironed can of a resin-coated metal sheet which is made by employing an ironing method as set forth in claim 5.

7. A drawn and ironed can of a resin-coated metal sheet which is made by employing an ironing method as set forth in claim 3.

8. A drawn and ironed can of a resin-coated metal sheet which is made by employing an ironing method as set forth in claim 2.

9. A method of ironing a resin-coated metal sheet as set forth in claim 1, further comprising:

providing an ironing ratio at the open end of the can body smaller than the ironing ratio in the middle portion of the sidewall of the can body, and providing a clearance between the reduced diameter portion of the punch and the inner surfaces of the die, wherein the clearance is wider than what causes damage to the coating resin.

10. A method of ironing a resin-coated metal sheet as set forth in claim 1, wherein the open end of the can body is formed by the reduced diameter portion at the rear end of the punch.

11. In a method of forming a can body from a resin-coated metal sheet which has been drawn into a cup shape having an open end, comprising ironing the cup shaped resin-coated metal sheet to form the can body having a sidewall, the improvement comprising placing the cup-shaped resin-coated metal sheet on a punch having a front section having a first diameter and a rear section having a second diameter, the front section being adjacent a free end of the punch and the first diameter being greater than the second diameter, the cup shaped resin-coated metal sheet being complementary in shape to the first section;

passing the punch with the cup shaped resin-coated metal sheet thereon through an ironing die from the free end of the punch along a length of the first section to iron the cup shaped resin-coated sheet and provide the can body having a reduced sidewall thickness and an increased height;

wherein said ironing results in the open end of the can body overlying the rear section of the punch having a reduced diameter so that the open end of the cup shaped resin-coated metal sheet is not ironed and has a greater thickness than the sidewall of the can body.

* * * * *